US005911604A

United States Patent [19]

Chadbourne

[11] Patent Number: 5,911,604

[45] Date of Patent: Jun. 15, 1999

[54] INSULATION PIERCING WEDGE CONNECTOR WITH SEAL

[75] Inventor: Richard Chadbourne, Merrimack, N.H.

[73] Assignee: Framatome Connectors USA Inc., Fairfield, Conn.

[21] Appl. No.: 09/123,684

[22] Filed: Jul. 28, 1998

[51] Int. Cl.[6] ..... H01R 4/24; H01R 11/20

[52] U.S. Cl. ..... 439/783; 439/784; 439/785; 439/790; 439/863

[58] Field of Search ..... 439/783, 784, 439/785, 790, 863, 433, 435, 436, 425, 429

[56] References Cited

U.S. PATENT DOCUMENTS 4,415,222 11/1983 Polidori .

5,679,031 10/1997 Chadbourne et al. ..... 439/783

FOREIGN PATENT DOCUMENTS 0810688 12/1997 European Pat. Off. .

2065994 7/1981 United Kingdom .

*Primary Examiner*—Steven L. Stephan

*Assistant Examiner*—Chandrika Prasad

*Attorney, Agent, or Firm*—Perman & Green, LLP

[57] ABSTRACT

An electrical wedge connector having a shell, a wedge assembly, seals and cushions. The wedge assembly has a dielectric frame and electrically conductive bars. The seals are mounted around the outer ends of the bars. The cushions are positioned between the conductors and the shell. When the wedge connector connects the two conductors the bars electrically connect the conductors in a sealed electrical connection.

19 Claims, 2 Drawing Sheets

INSULATION PIERCING WEDGE CONNECTOR WITH SEAL

BACKGROUND OF THE INVENTION

1. Field of the Invention

The present invention relates to electrical connectors and, more particularly, to a wedge connector.

2. Prior Art

European Patent Office publication No. EP 0810688 discloses a wedge connector for piercing through insulated conductors. U.K. patent publication No. 2065994 also discloses a wedge connector with a wedge capable of piercing through insulation on a conductor. U.S. Pat. No. 5,679,031 discloses retention barbs on a wedge connector shell.

SUMMARY OF THE INVENTION

In accordance with one embodiment of the present invention an electrical wedge connector is provided comprising a shell and a wedge assembly. The wedge assembly is adapted to be inserted into the shell to electrically connect two electrical conductors to each other. The wedge assembly comprises a frame, conductor insulation piercing projections on the frame, and at least one seal around the piercing projections. The projections are sized and shaped to pierce through the conductors to make electrical contact with electrical conducting sections of the conductors. The at least one seal forms a seal around the projections between the conductors and the frame.

In accordance with another embodiment of the present invention an electrical wedge connector is provided comprising a shell, a wedge, and at least one conductor cushion. The wedge is adapted to be inserted into a shell for mechanically and electrically connecting two conductors to each other. The at least one conductor cushion is sized and shaped to be located between an interior side of the shell and a first one of the conductors. The cushion prevents the shell from damaging insulation on the first conductor as the first conductor is moved towards the interior side during insertion of the wedge into the shell.

In accordance with one method of the present invention a method of electrically and mechanically connecting two conductors in a wedge connector, the wedge connector having a shell and a wedge, is provided comprising steps of providing the wedge with a frame and conductor piercing projecting sections; positioning seal members on the wedge, the seal members surrounding a portion of the conductor piercing projecting sections; and inserting the wedge into the shell with the two conductors on opposite sides of the wedge. The projecting sections penetrate into the conductors and the seal members form seals around the projecting sections between the conductors and the frame of the wedge.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
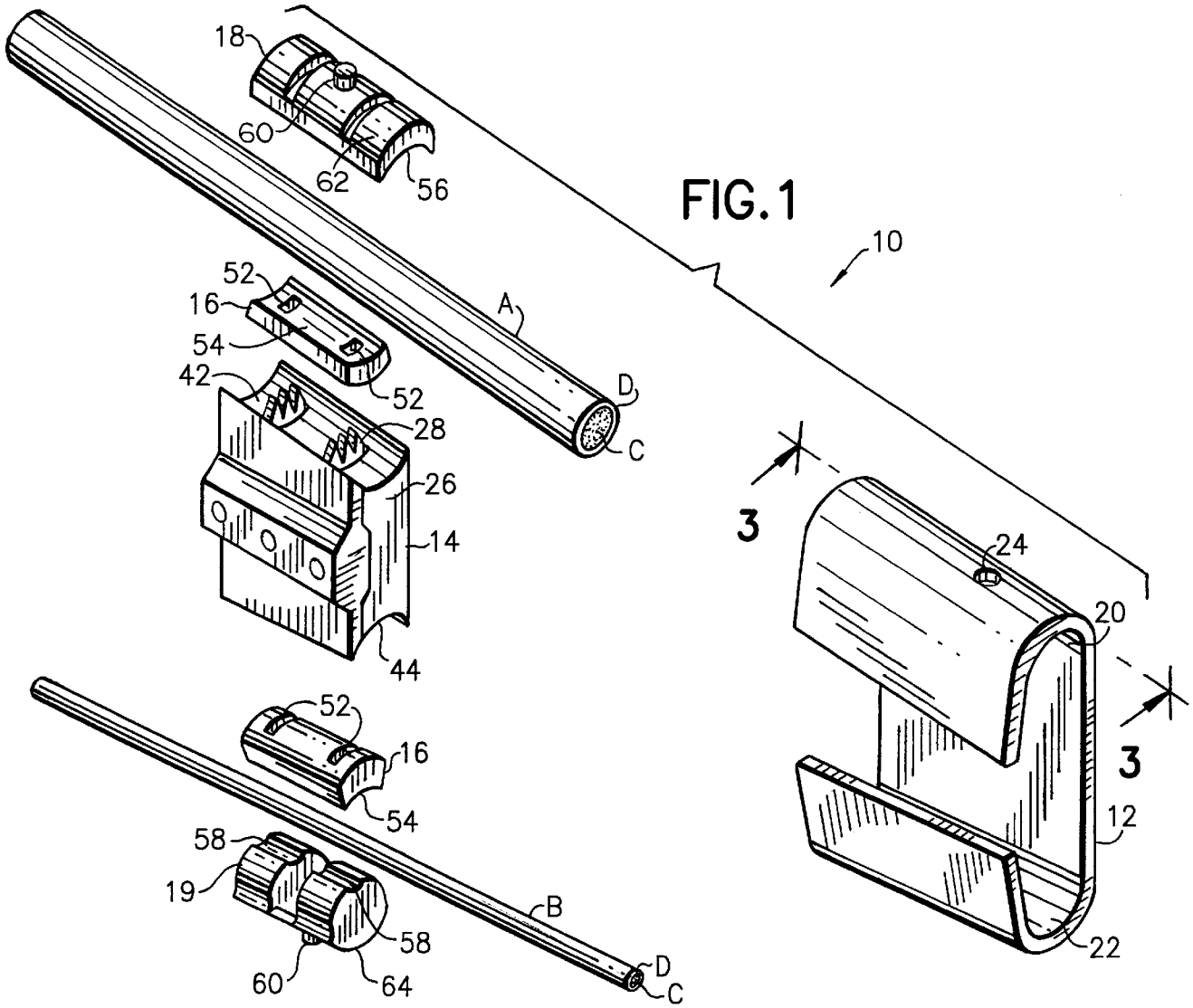
FIG. 1 is an exploded perspective view of two conductors and an electrical wedge connector incorporating features of the present invention.

Referring to FIG. 1, there is shown an exploded perspective view of an electrical wedge connector 10 incorporating features of the present invention and two conductors A, B. Although the present invention will be described with reference to the single embodiment shown in the drawings, it should be understood that the present invention can be embodied in many alternate forms of embodiments. In addition, any suitable size, shape or type of elements or materials could be used.

The conductors A, B generally comprise an inner electrically conductive section C and an outer layer of electrically insulating material D. The connector 10 generally comprises a shell 12, a wedge assembly 14, seals 16 and cushions 18, 19. The shell 12 is a one-piece member preferably comprised of metal. The shell 12 has a general cross-sectional "C" shape and tapers from rear to front to form a general wedge shaped profile. The "C" shape forms two conductor receiving areas 20, 22 on opposite top and bottom sides of the shell. In this embodiment the top and bottom sides have locking holes 24 as further described below. However, in alternate embodiments other types of shells could be used.

Figure 2:
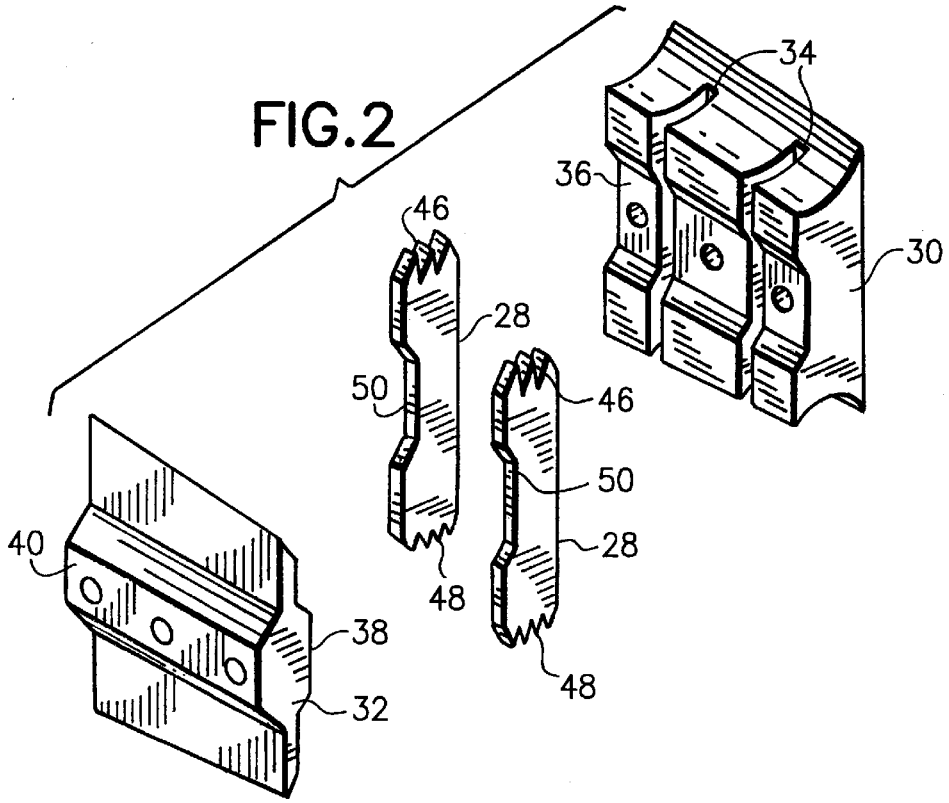
FIG. 2 is an exploded perspective view of the wedge shown in FIG. 1.

The wedge assembly 14 comprises a frame 26 and insulation piercers 28. Referring also to FIG. 2, in this embodiment the frame 26 is comprised of two pieces 30, 32 that are connected to each other be fasteners (not shown). However, in alternate embodiments other types of frames could be used. The first frame piece 30 has slots 34 for receiving the piercers 28 and a side notch 36. The second frame piece 32 has an inner side projection 38 and an outer side projection 40. The inner side projection 38 is adapted to interlockingly mate with the side notch 36. The two frame pieces 30, 32 form top and bottom curved surfaces 42, 44. The frame 26 has a general wedge shaped profile from front to rear. The frame pieces 30, 32 could be comprised of either electrically conductive or non-conductive material.

The insulation piercers 28, in this embodiment, are two bars of electrically conductive material. However, in alternate embodiments other types and numbers of piercers could be provided, such as piercers formed integrally with the frame or which do not fully extend across the height of the frame with the frame acting as an electrical bridge. In this embodiment the bars 28 are substantially the same, but different in height. Each bar 28 has top and bottom teeth 46, 48 and a side notch 50. The bars 28 are positioned in the slots 34 and, when the two frame pieces 30, 32 are connected to each other, the inner side projection 38 of the second frame piece 32 extends into the side notches 50 to lock the bars 28 into the frame 26. The teeth 46, 48 extend out of the opposite ends of the slots 34. In an alternate embodiment, the frame 26 could be molded onto the bars 28. The seals 16 could also be molded onto the frame 26 and/or the bars 28.

The seals 16 are preferably comprised of a resilient material, such as rubber or polymer. Each seal has holes 52 which are sized and shaped to pass the teeth 46, 48 therethrough. The seals 16 have a curved shape to seat against the curved surfaces 42, 44 of the frame 26 and provide curved contact surfaces 54 for contacting the conductors A, B. The cushions 18, 19 are preferably comprised of a plastic or polymer material. Each cushion 18, 19 has a first side with a curved surface 56, 58 for contacting the conductors A, B and a second opposite side 62, 64 with projections 60. The second sides 62, 64 are curved to be matingly received in the shell receiving areas 20, 22. The projections 60 are sized and shaped to be received in the holes 24 of the shell 12 to longitudinally lock the cushions 18, 19 relative to the shell 12. However, in alternate embodiments, alternate, additional or no locking features need be provided. In a preferred embodiment the cushions 18, 19 can be selected from a variety of different size and shape cushions corresponding to the size of the conductors A, B intended to be connected.

Figure 3:
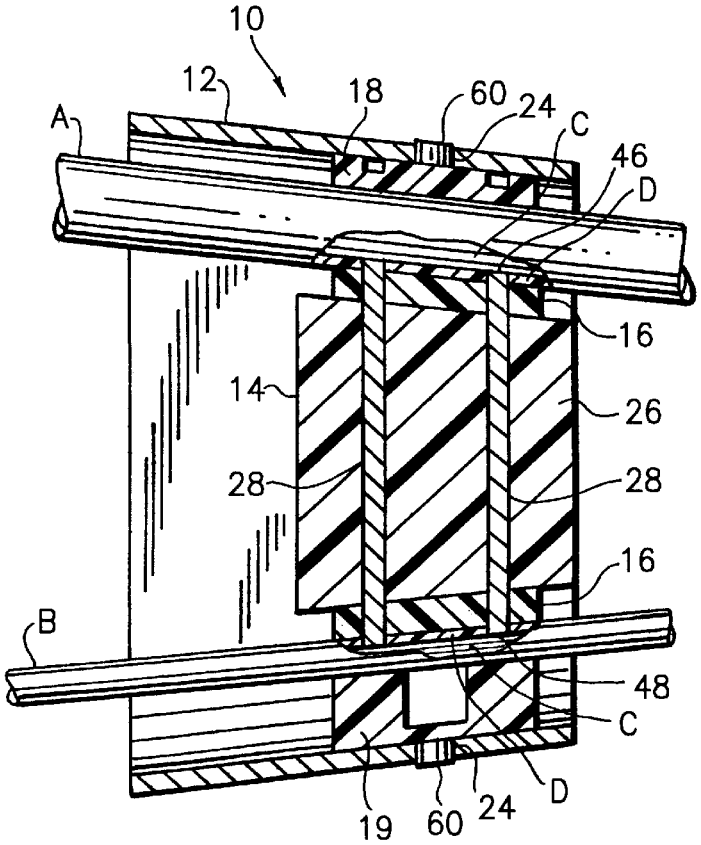
FIG. 3 is a cross-sectional view of the conductor and connector assembly shown in FIG. 1 taken along line 3—3.

Referring also to FIG. 3, the wedge connector 10 is shown connecting the two conductors A, B to each other. The cushions 18, 19 are located between the conductors A, B and the shell 12. The cushions 18, 19 help to prevent the shell 12 from inadvertently damaging the insulating layers D on the conductors A, B and help to position the conductors A, B relative to each other for proper mechanical connection of the wedge assembly 14. The projections 60 are located in the holes 24 to longitudinally lock the cushions 18, 19 in place. When the wedge assembly 14 is inserted, the teeth 46, 48 of the bars 28 penetrate through the insulation D of the conductors A, B and make electrical contact with the electrically conductive sections C. The seals 16 are able to compress and form a seal around the bars 28 between the frame 26 and the conductors A, B. Thus, the bars 28 make an electrical connection between the conductors A, B, but the connection is a sealed electrical connection. In alternate embodiments more or less than two seals could be used and/or more or less than two cushions could be used.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a shell; and a wedge assembly adapted to be inserted into the shell to electrically connect two electrical conductors to each other, the wedge assembly comprising a frame, conductor insulation piercing projections on the frame, and at least one seal around the piercing projections, wherein the projections are sized and shaped to pierce through the conductors to make electrical contact with electrical conducting sections of the conductors, and wherein the at least one seal forms a seal around the projections between the conductors and the frame.

2. A wedge connector as in claim 1 wherein the wedge assembly has two of the seals which are located on opposite sides of the frame.

3. A wedge connector as in claim 1 wherein the seal has slots therethrough and wherein the piercing projections extend through the slots.

4. A wedge connector as in claim 1 wherein the piercing projections comprise bars with teeth on opposite ends that are mounted to the frame with the opposite end teeth of each bar extending from opposite side of the frame.

5. A wedge connector as in claim 4 wherein the frame has two frame pieces, stationarily connected to each other, and wherein a first one of the frame pieces has slots with the bars located in the slots.

6. A wedge connector as in claim 1 further comprising cushion members which are sized and shaped to be positioned against inside surfaces of the shell opposite the seals, wherein the conductors are positioned between the cushion members and the seals.

7. A wedge connector as in claim 6 wherein the shell and the cushion members have interlocking sections that longitudinally lock the positions of the cushion members in the shell at predetermined positions.

8. A wedge connector as in claim 7 wherein the cushion members have curved longitudinal conductor contacting surfaces.

9. An electrical wedge connector comprising:

a shell;

a wedge adapted to be inserted into the shell for mechanically and electrically connecting two conductors to each other; and at least one conductor cushion which is sized and shaped to be located between an interior side of the shell and a first one of the conductors, wherein the cushion prevents the shell from damaging insulation on the first conductor as the first conductor is moved towards the interior side during insertion of the wedge into the shell.

10. A wedge connector as in claim 9 wherein the cushion has a curved inner surface for contacting the first conductor and a curved outer surface for contacting the interior side of the shell.

11. A wedge connector as in claim 9 wherein the shell and the cushion include interlocking sections for longitudinally locking the cushion in a predetermined position relative to the shell.

12. A wedge connector as in claim 9 wherein the connector has two of the cushions adapted to be located on opposite interior sides of the shell.

13. A wedge connector as in claim 12 wherein the two cushions have different shapes.

14. A wedge connector as in claim 9 further comprising at least one seal which is sized and shaped to be located between the first conductor and a frame of the wedge.

15. A wedge connector as in claim 9 wherein the wedge comprises a frame and insulation piercing projections extending from opposite sides of the frame for piercing into electrical conducting sections of the conductors when the wedge is inserted into the shell.

16. A wedge connector as in claim 15 further comprising two seals located against the opposite sides of the frame and having slots with the projections extending through the slots.

17. A method of electrically and mechanically connecting two conductors in a wedge connector, the wedge connector having a shell and a wedge, the method comprising steps of:

providing the wedge with a frame and conductor piercing projecting sections;

positioning seal members on the wedge, the seal members surrounding a portion of the conductor piercing projecting sections; and inserting the wedge into the shell with the two conductors on opposite sides of the wedge, wherein the projecting sections penetrate into the conductors and the seal members form seals around the projecting sections between the conductors and the frame of the wedge.

18. A method as in claim 17 further comprising positioning cushion members between the conductors and opposite interior sides of the shell to prevent the shell from damaging insulation of the conductors.

19. A method as in claim 18 further comprising longitudinally interlocking the cushion members to the shell at predetermined positions of the cushion members relative to the shell.

* * * * *